United States Patent [19]

Eisenlohr

[11] Patent Number: 4,682,633

[45] Date of Patent: Jul. 28, 1987

[54] DEVICE FOR SCREENING FLUFF FROM ENTERING A SHED

[75] Inventor: Franz Eisenlohr, Tuttwil, Switzerland

[73] Assignee: Sulzer Brothers Limited, Winterthur, Switzerland

[21] Appl. No.: 814,190

[22] Filed: Dec. 27, 1985

[30] Foreign Application Priority Data

Feb. 5, 1985 [EP] European Pat. Off. ..... 85 810042

[51] Int. Cl.[4] ..... D03D 49/00

[52] U.S. Cl. ..... 139/1 C; 139/450

[58] Field of Search ..... 139/1 R, 1 C, 437, 438, 139/439, 450, 429, 302; 66/125 R

[56] References Cited

U.S. PATENT DOCUMENTS

| | | | |
|---|---|---|---|
| 2,954,056 | 9/1960 | Whewell | 139/450 |
| 3,380,482 | 4/1968 | Scherillo | 139/302 |
| 4,084,623 | 4/1978 | Tojo et al. | 139/1 C |
| 4,546,799 | 10/1985 | Riesen | 139/1 C |

FOREIGN PATENT DOCUMENTS

| | | | |
|---|---|---|---|
| 534757 | 4/1973 | Switzerland | 139/1 C |

*Primary Examiner*—Henry S. Jaudon

*Attorney, Agent, or Firm*—Kenyon & Kenyon

[57] ABSTRACT

The cleaning device employs a screening plate at the entry end of a reed through which a weft yarn can be picked and a cleaning element mounted at the beating-up line for scraping fluff from the screening plate.

Plates may also be mounted adjacent the screen plate in order to reduce the aperture in the screening plate after a weft yarn has been picked therethrough while at the same time scraping fluff from the screening plate.

In another embodiment, the cleaning device may have screening plates mounted on a shears through which the weft yarn is picked. In this embodiment, the screening plates can be moved towards each other to reduce the aperture through which the weft yarn is picked and subsequently moved into overlapping relation during severing of a weft yarn by the shears.

14 Claims, 9 Drawing Figures

DEVICE FOR SCREENING FLUFF FROM ENTERING A SHED

This invention relates to a device for screening fluff from entering a shed. More particularly, this invention relates to a device for screening out fluff from entering a weft yarn entry zone of a weaving machine.

As is known, when weft yarns are woven at high picking rates, depending on the nature of the yarn, there is fairly severe abrasion of the yarn fibers or additives which stick, whether wanted or not, to the spun yarn. This abraded material is called "fluff" in weaving. Further, this fluff presents a particular problem at places where the yarn experiences scouring, for example, at places of reversal.

Generally, individual particles which enter into a shed of a weaving machine and, therefore, the fabric, with the weft yarn or with air entraining the yarn do not cause difficulties since these particles are not apparent in comparison with yarn thickness. However, fluff accumulates on various parts of the weaving machine to form fluff pads or cushions or the like, for example, on drive elements or yarn eyes. When a pad of this kind is picked into the shed, a fault arises in the cloth texture and reduces the quality and sales value of the woven cloth.

Accordingly, various types of means have been provided for cleaning the weft yarn entry zone of a weaving machine, that is, the zone which extends from a weft bobbin by way of an intermediate weft yarn store, which may be provided, and a picking means, for example a projectile or an air stream, as far as entry into the shed formed by a multiplicity of warp yarns, In the case of multicolor weaving machines, the entry zone may encompass a plurality of weft yarns. Generally, the means for cleaning the weft yarn entry zone have been developed to remove the fluff accumulating on parts of the machine or to completely prevent the accumulation of fluff. Such devices have taken the form, for example, of blowers and/or suction extractors which are either secured to individual weaving machines or which reciprocate individually over groups of weaving machines. Devices of this type with pivotal nozzles are described, for example in German Pat. No. 1535894, German O.S. No. 1919229 and U.S. Pat. No. 2,798,825. Use has also been made of screens or plates which are formed with apertures through which a weft yarn or picking means may pass in order to inhibit airflows in the picking direction of the weft yarn and, therefore, further conveyance of fluff towards a shed.

However, it has been found that the known devices for cleaning the weft yarn entry zones of weaving machines do not satisfactorily prevent fluff from entering the shed. Further, the known devices have been expensive and, because of their air consumption, increase operating costs.

Accordingly, it is an object of the invention to provide a very simple and effective device for inhibiting accumulations of fluff and the further conveyance of pads of fluff into a weft yarn entry zone of a weaving machine.

It is another object of the invention to reduce the operational cost of a weaving machine due to cleaning.

It is another object of the invention to provide a relatively simple cleaning device which can be accommodated upon a weaving machine to screen out fluff from a shed.

Briefly, the invention provides a cleaning device for a weaving machine having a weft yarn entry zone for picking of a weft yarn into a shed. The device is constructed to screen out fluff in the entry zone and to this end includes at least one screening plate having an opening for passage of a picked weft yarn therethrough and at least one cleaning element which is cooperable with the screening plate in order to screen fluff from entering the shed. In accordance with the invention, at least one of the screening plate and the cleaning element is movable relative to the other in order to scrape fluff from between each other.

The cleaning device may be used in weaving machines in which a projectile is used to pick a weft thread into a shed or in weaving machines which employ an air stream for picking the weft yarn into a shed.

The construction of the cleaning device is such that the fluff being carried along and impinging on the screening plate is scraped off because of the relative movement between the screening plate and cleaning element. Thus, the fluff is not picked into the shed. Consequently, without additional elaborate means such as blowers, the fluff can drop into the interior of the machine and can then be drawn away, for example, together with fluff from the warp yarns. If cloth quality requirements are very stringent, air appliances for keeping the weft yarn entry zone clean can be operated at a reduced air pressure and, therefore, reduced energy consumption.

The dimensions of the cleaning device can be relatively small as compared to the previously known devices. This presents fewer obstacles to personnel servicing a weaving machine.

The cleaning device can be used with particular advantage, for example, for projectile weaving machines, In this case, after the projectile has passed through the screening plate, the opening through which the projectile passes may be reduced so that the weft yarn can continue to passed through unhindered but without any pads of fluff on the weft yarn finding a way through the opening.

These and other objects and advantages of the invention will become more apparent from the following detailed description taken in conjunction with the accompanying drawings wherein.

Figure 3:
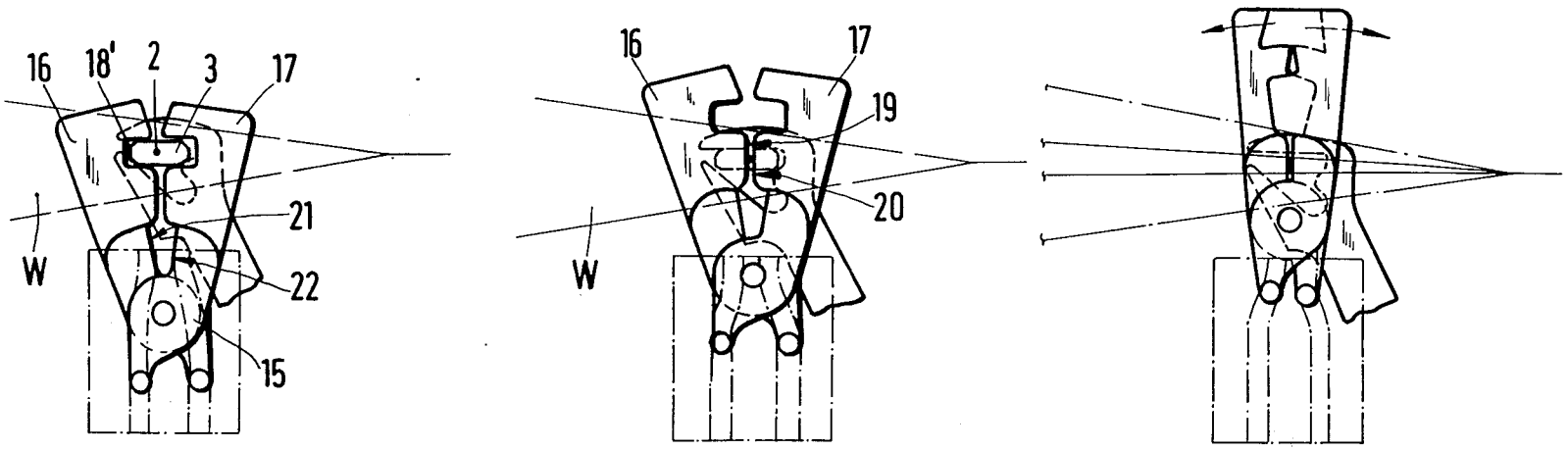
Figure 4:
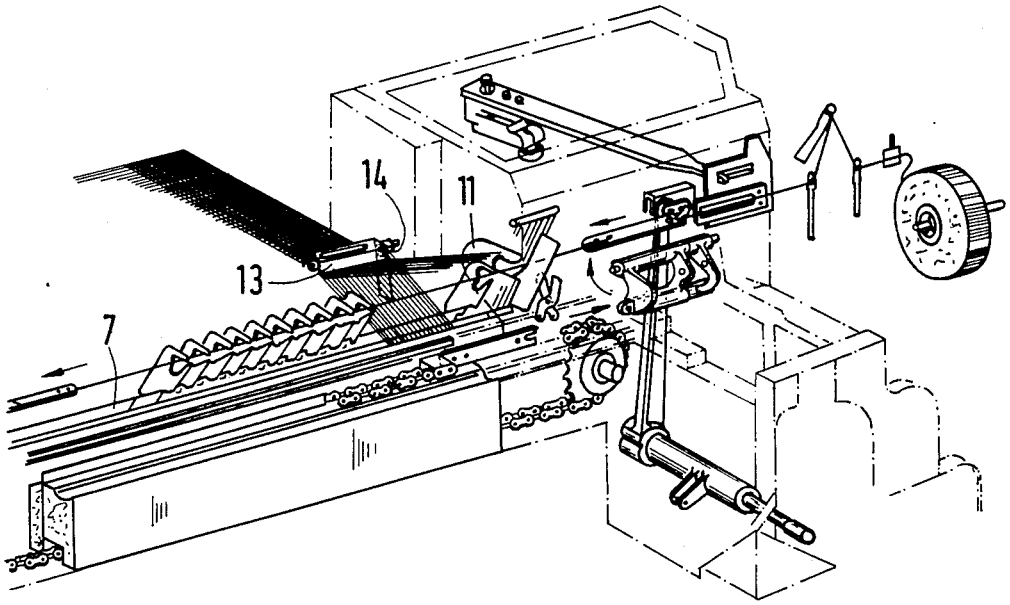
Figure 5:
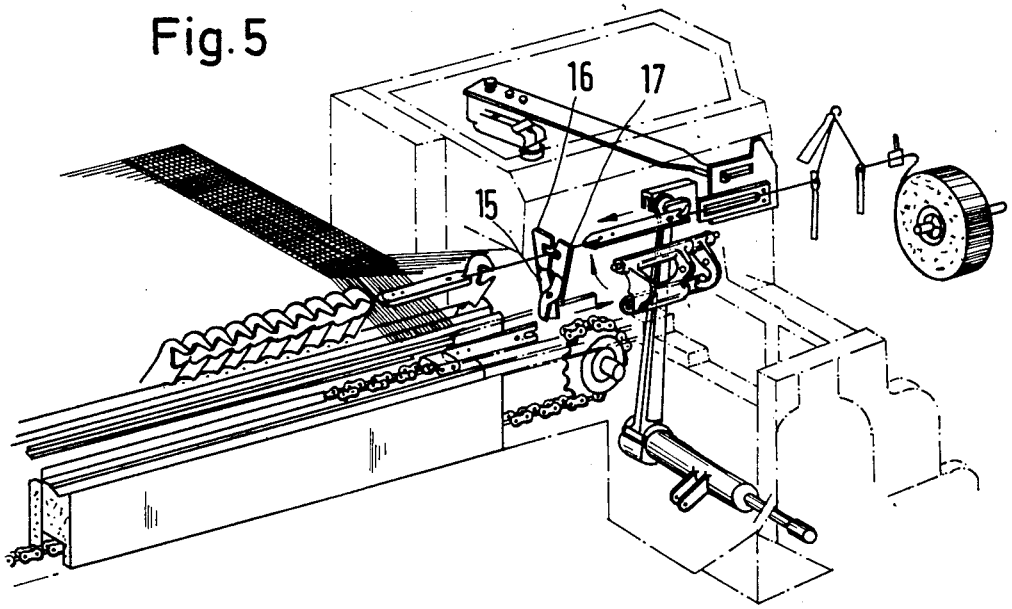
Figure 6:
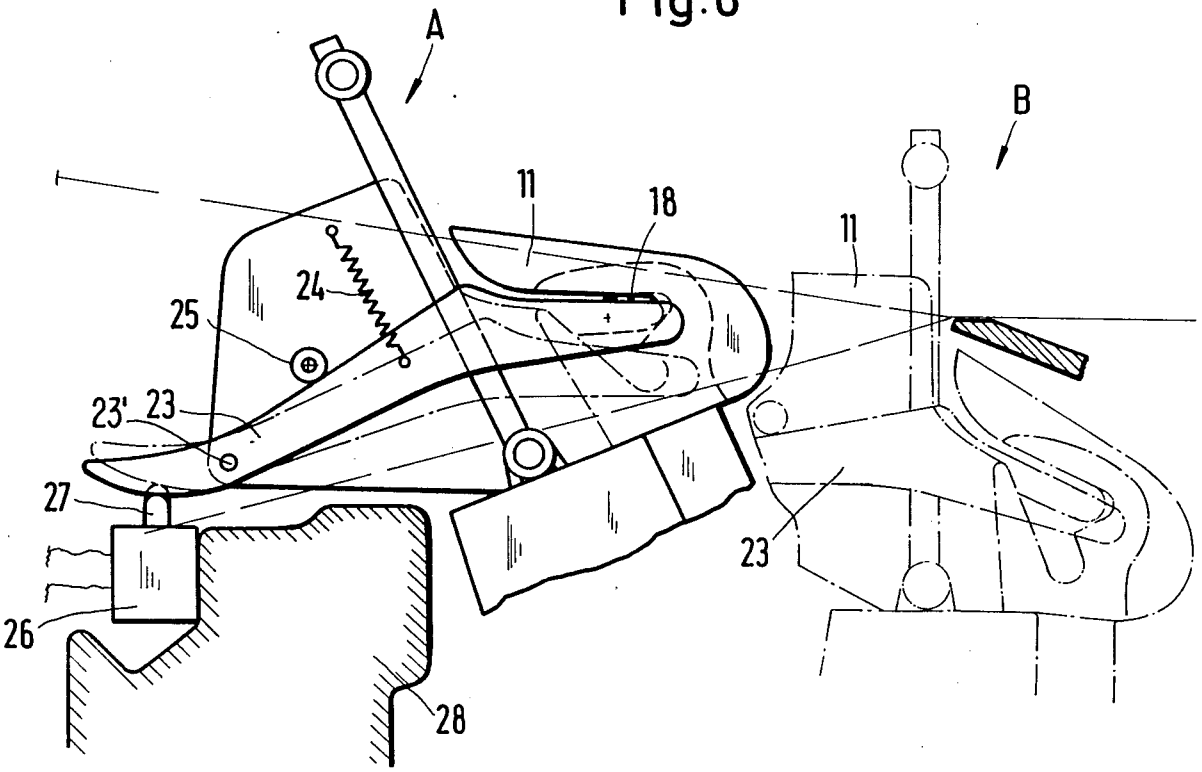
Figure 7:
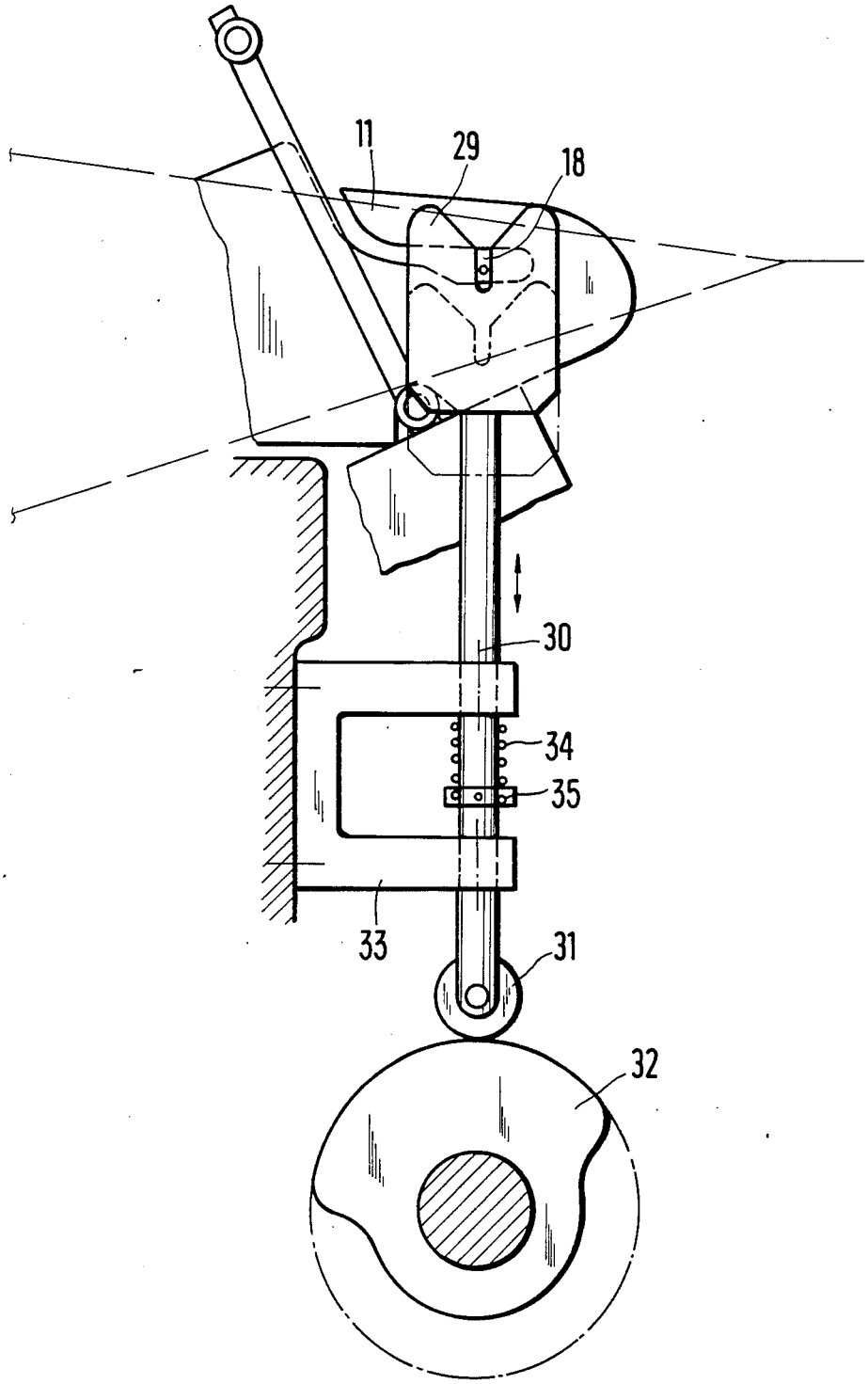

FIG. 3*a* illustrates a cleaning device mounted on a shears of a weaving machine in accordance with the invention;

FIG. 3*b* illustrates the cleaning device of FIG. 3*a* in a partially closed position during picking;

FIG. 3*c* illustrates the cleaning device of FIG. 3*a* in an overlapped position during severing of a weft thread;

FIG. 4 illustrates a perspective view of a projectile weaving machine employing a cleaning device in accordance with the invention;

FIG. 5 illustrates a perspective view of a weaving machine employing a cleaning device as illustrated in FIG. 3;

FIG. 6 illustrates a part side view of a weaving machine employing a modified cleaning device in accordance with the invention; and FIG. 7 illustrates a side view of a further modified cleaning device in accordance with the invention.

Figure 1:
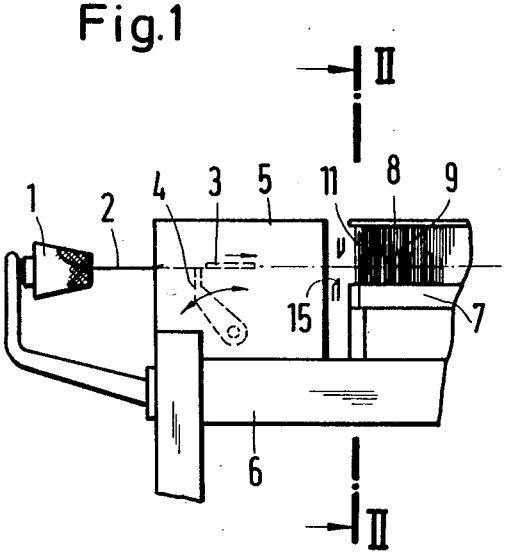
FIG. 1 illustrates a diagrammatic view of a weft yarn entry zone of a weaving machine employing a cleaning device in accordance with the invention.

Referring to FIG. 1, the projectile weaving machine includes a weft yarn bobbin 1 for supplying a weft yarn 2 and a picking means in the form of a projectile 3 for picking of the weft yarn 2 into a shed. As indicated, the projectile 3 is picked to the right, as viewed, into the shed by a reciprocating accelerating lever 4. An accelerating mechanism (not shown) drives the lever 4 and is received in a gearbox 5 which is mounted on a central carrier 6 of the weaving machine. The carrier 6 also supports a cam drive (not shown) for a sley 7 on which a reed 8 for beating up the weft yarn 2 is mounted along with a plurality of guide teeth 9 which define a guide channel for the projectile 3. Vertically movable shears 15 are also provided to the left of the reed 8 for severing the weft yarn 2 after picking.

Figure 2:
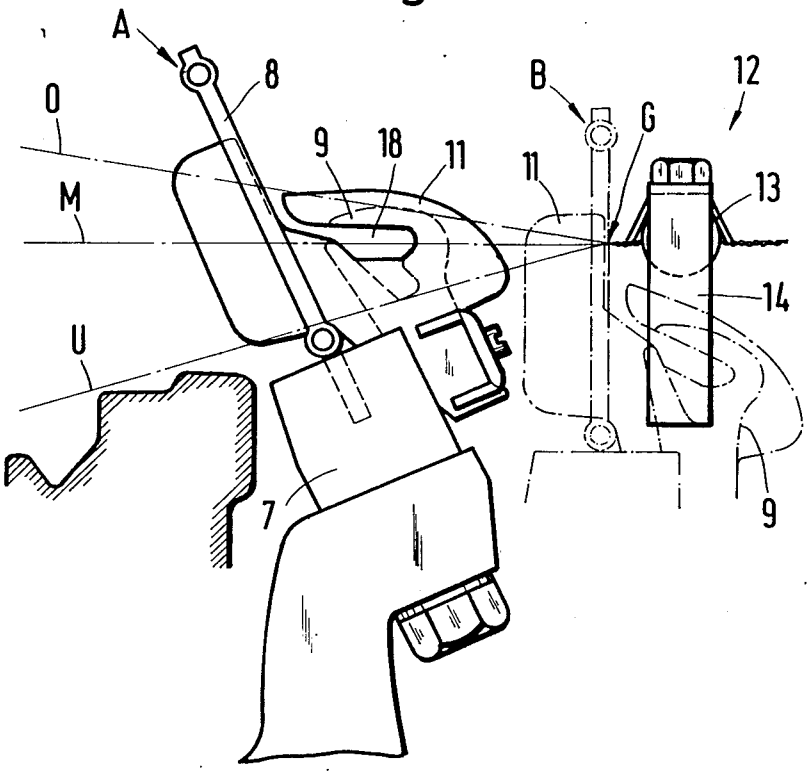
FIG. 2 illustrates a view taken on line II—II of FIG. 1.

Referring to FIG. 2, the sley 7 serves to move the reed 8 and guide teeth 9 from the solid line position A for the picking of a weft yarn to a dotted line position B for beatingup of the weft yarn at a cloth edge G. As indicated, the center of rotation of the sley 7 is positioned so that the guide teeth 9 take up a position below the cloth edge G in position B. Further, during picking, the warp yarns are in the planes O, U which are perpendicular to the plane of the drawing while at beating-up the warp yarns are moved into the central plane M. A shed is thus defined between the planes O, U.

Referring to FIGS. 2 and 4, a cleaning device is provided for screening out fluff from the shed during picking. This cleaning device includes a screening plate 11 which is mounted on the sley 7 and a cleaning element 14 which is mounted on a temple cover 13 adjacent to the beating-up position. The screening plate 11 is mounted at the end of the sley between the shears 15 and the first guide tooth 9 as indicated in FIG. 1. Further, as shown in FIG. 2, the screening plate 11 has a mounting portion which is secured to the sley 7 by means of screws in a manner similar to the securement of the guide teeth 9 to the sley 7. In addition, the screening plate 11 is of an enlarged shape relative to the guide teeth 9 and has an opening 18 for the passage of a picked weft yarn. This opening 18 is aligned with the apertures in the guide teeth 9. A slot always extends from the opening 18 towards the reed 8 in order to permit release of the weft yarn towards the reed 8 during beating-up of the cloth edge G. Still further, the screening plate 11 has an extension shown to the left in FIG. 2 of generally rectangular shape which extends between two adjacent dents of the reed 8, which dents, in turn, provide stability to the plate 11. The height of the screening plate 11 is such that the warp yarns are disposed within the contour of the plate 11 in all positions as indicated in FIG. 2. The warp yarns which are disposed laterally downstream of the plate 11 contact the surface of the plate and keep the surface clear of fluff accumulations.

The cleaning element 14 is secured to the temple cover 13 at a reduced lateral distance from the screening plate 11. The function of the cleaning element 14 is to scrape the accumulations of fluff off the screening plate 11 precisely in the region of the opening 18 when the screening plate 11 approaches the beating-up position.

Of note, the screening plate 11 is secured to the sley 7 as far to the left as possible, as indicated in FIG. 1 in order to ensure that accumulations of fluff cannot get near the reed 8.

Referring to FIGS. 3*a*, 3*b* and 3*c*, the cleaning device may be constructed in the form of a pair of movable screening plates 16, 17 which are movable towards each other and which define an aperture for picking of a weft yarn therethrough. In this case, the screening plates 16, 17 are disposed at a reduced lateral separation from one another in the picking direction and are disposed on the arms of a shears 15 disposed immediately before entry into the shed as shown in FIG: 5. As indicated, the shears 15 also has a pair of cutting edges 21, 22 which serve to sever the weft yarn after picking.

As indicated in FIG. 3*a*, during picking, the shears are in a bottom position so that the weft yarn extends centrally through the aperture 18' bounded by the screening plates 16, 17. At this time, the aperture 18 is large enough for a projectile 3 to pass through.

Immediately after the projectile 3 has passed through, the shears 15 rise in the open state so that the weft yarn then passes through a narrow gap bounded by the edges 19, 20 of the screening plates 16, 17 as indicated in FIG. 3*b*.

Upon completion of picking, the shears 15 move into the top position, as viewed in FIG. 3*c*, and severs the weft yarn via the cutting edges 21, 22. At this time, the screening plates 16, 17 overlap so that accumulations of fluff can be scraped off the facing surfaces. In order to clean those surfaces of the plates 16, 17 which are distant from one another, other stationary parts (not shown) similar to the cleaning element 14 of FIG. 4, or brushes, can be provided to the left and right of the respective plates 16, 17. These stationary elements may become operative when the shears 15 are in the bottom open position.

As shown in dotted lines in FIGS. 3*a*, 3*b*, and 3*c*, the shears 15 are guided via suitable camming grooves during upward travel to move into a closed position for severing purposes. During this time, the shears 15 carry the plates 15, 17 therealong.

As an alternative, the screening plates 16, 17 may move towards each other immediately after passage of the picking means so that the horizontal internal width of the aperture 18' is reduced to the amount necessary for the passage of the weft yarn 2. In this case, there is no vertical movement of the screening plates 16, 17. This enables the aperture 18' to be reduced very rapidly during picking and provides a very effective barrier to the entry of fluff into the shed.

Of note, the screening plates 16, 17 which are moveable relative to each other and to stationary scraping elements can readily be disposed on other moving elements in the picking zone. If only one of the plates 16 or 17 moves, the moving plate may be arranged in the form of two members which register with each other so that during relative movement, the opposite stationary plate moves into the gap between the moving members. In this case, the stationary plate is cleaned on both sides.

Referring to FIG. 5, the shears 15 which carries the screening plate 16, 17 is mounted at a point adjacent to the shed of the weaving machine.

Referring to FIG. 6, wherein like references characters indicate like parts as above, an elongated plate 23 may be rotatably mounted on the screening plate 11 via a pivot 23' for movement over the aperture 18 in the screening plate after picking of a weft yarn through the aperture 18 in order to screen out fluff from the shed. This elongated plate 23 is thus operative both as a cleaning element and as a screening plate. As indicated, the elongated plate is biased by a spring 24 secured to the plate 11 against an eccentric abutment 25 on the plate 11 and abuts against a tappet 27 of an electromagnet 26. With the tappet 27 in a raised position, the plate 23 takes up the dotted line position so as to permit passage of a projectile through the aperture 18 of the screening plate 11. When the tappet 27 is drawn into the electromagnet 26, the elongated plate 23 pivots into the solid line position so as to reduce the size of the aperture 18 so that the aperture is almost closed as shown. This action occurs after passage of the projectile through the screening plate 11. As indicated, the electromagnet 26 is secured to a cross-member 28 of the weaving machine frame.

Referring to FIG. 7, the cleaning device may be provided with a reciprocably mounted plate 29 for movement over the aperture 18 in the screening plate 11 after picking of a weft yarn through the aperture 18 to screen out fluff from the shed. As indicated, the plate 29 is disposed for vertical movement, as indicated by the double arrow. In addition, the plate 29 is slidably mounted via a rod 30 in a suitable holder 33 secured to the machine frame and is driven via a cam roller 31 secured to the end of the rod 30 and a cam 32 which is disposed on the main shaft of the weaving machine. In addition, a spring 34 is disposed about the rod 30 within the holder 33 and abuts a ring 35 secured to the rod 30 in order to bias the rod 30 downwardly against the cam 32. When in the lowered dotted line position, the plate 29 permits the passage of a picking means through the aperture 18 of the screening plate 11. After the picking means has passed through the aperture 18 and while picking is still proceeding, the plate 29 is moved upwardly via the cam 32 so as to reduce the size of the aperture 18 to a size sufficient to permit passage of the weft yarn.

When the plate 29 moves upwardly, a scrapinq action occurs with respect to the screening plate 11, in a similar manner to the action taking place between pivoting plate 23 on the screening plate 11 of FIG. 6 in order to remove fluff from therebetween.

The invention thus provides a relatively simple cleaning device for screening fluff from a shed of a weaving machine. Further, the invention provides a cleaning device which is able to carry out a screening action at a minimum of cost.

What is claimed is:

1. In a weaving machine having a weft yarn entry zone for picking of a weft yarn into a shed, a device for screening out fluff in said entry zone, said device including at least one screening plate having an opening for passage of a picked weft yarn therethrough;

at least one stationary cleaning element cooperable with said screening plate to screen fluff from entering said shed; and said screening plate being movable relative to said cleaning element to scrape fluff from between said plate and said element.

2. In a weaving machine, the combination of a sley having a guide channel for guiding a picked yarn from a weft yarn entry zone through a shed and a reed for beating-up a picked yarn in the shed into a cloth at a beating-up line; and a cleaning device for screening out fluff from entering the shed, said device including at least one screening plate mounted on said sley upstream of said guide channel relative to a picked yarn and having an opening in alignment with said guide channel for passage of a picked yarn therethrough and at least one cleaning element cooperable with said screening plate to screen fluff from entering the shed, at least one of said plate and said element being movable relative to the other to scrape fluff from therebetween.

3. The combination as set forth in claim 2 wherein said reed includes a plurality of dents for guiding warp yarns therebetween and said screening plate is retained between a pair of said dents.

4. The combination as set forth in claim 2 wherein said cleaning element is stationarily mounted at said beating-up line to overlap with said screening plate during beating-up of a weft yarn.

5. The combination as set forth in claim 2 wherein said screening plate is of a size to dispose the warp yarns of said shed within the contour of said screening plate.

6. The combination as set forth in claim 2 wherein said screening plate has a downstream surface adjacent the shed to permit warp yarns in the shed to contact and clean said surface during beating-up.

7. The combination as set forth in claim 6 wherein said cleaning element is disposed to scrape an upstream surface of said screening plate.

8. The combination as set forth in claim 2 wherein said cleaning element is disposed to scrape an upstream surface of said screening plate.

9. In a weaving machine, the combination of a sley having a guide channel for guiding a picked yarn from a weft yarn entry zone through a shed and a reed for beating-up a picked yarn in the shed into a cloth at a beating-up line; and a cleaning device for screening out fluff from entering the shed, said device including a first plate having an opening for passage of a picked yarn therethrough and being disposed to screen fluff from entering the shed and a second plate stationarily mounted at said beating-up line to overlap with said first plate during beating-up of a weft yarn and cooperable with said first plate to scrape fluff from said first plate.

10. The combination as set forth in claim 9 wherein said first plate is mounted on said sley upstream of said guide channel relative to a picked yarn.

11. The combination as set forth in claim 10 wherein said first plate is of a height to dispose the warp yarns of the shed within the contour of said first plate.

12. The combination as set forth in claim 9 wherein said second plate is disposed to scrape an upstream surface of said first plate.

13. The combination as set forth in claim 9 wherein said first plate has a downstream surface adjacent the shed to permit warp yarns in the shed to contact and clean said surface during beating-up.

14. In a weaving machine, the combination of a sley having a guide channel for guiding a picked yarn from a weft yarn entry zone through a shed and a reed for beating-up a picked yarn in the shed into a cloth at a beating-up line; and a cleaning device for screening out fluff from entering the shed, said device including a first plate having an opening for passage of a picked yarn therethrough and being disposed to screen fluff from entering the shed, said first plate having a downstream surface adjacent the shed to permit warp yarns in the shed to contact and clean said surface during beating-up and a second plate cooperable with said first plate to scrape fluff from said first plate, at least one of said plates being movable relative to the other of said plates to scrape fluff from therebetween.

* * * * *